US007198386B2

(12) United States Patent
Zampini et al.

(10) Patent No.: US 7,198,386 B2
(45) Date of Patent: Apr. 3, 2007

(54) VERSATILE THERMALLY ADVANCED LED FIXTURE

(75) Inventors: Thomas Lawrence Zampini, Morris, CT (US); Thomas Lawrence Zampini, II, Morris, CT (US); Mark Alphonse Zampini, Morris, CT (US)

(73) Assignee: Integrated Illumination Systems, Inc., Morris, CT (US)

( * ) Notice: Subject to any disclaimer, the term of this patent is extended or adjusted under 35 U.S.C. 154(b) by 63 days.

(21) Appl. No.: 10/941,081

(22) Filed: Sep. 15, 2004

(65) Prior Publication Data

US 2005/0083698 A1 Apr. 21, 2005

Related U.S. Application Data

(60) Provisional application No. 60/481,387, filed on Sep. 17, 2003.

(51) Int. Cl.
*F21V 29/00* (2006.01)

(52) U.S. Cl. ..... 362/294; 362/345; 362/373; 362/800

(58) Field of Classification Search ..... 362/294, 362/547, 345, 545, 555, 800, 373, 249; 257/81, 257/99, 100, 82, 88, 98
See application file for complete search history.

(56) References Cited

U.S. PATENT DOCUMENTS

| | | | | |
|---|---|---|---|---|
| 6,541,800 | B2 | 4/2003 | Barnett et al. | 257/98 |
| 6,799,864 | B2 * | 10/2004 | Bohler et al. | 362/236 |
| 6,897,486 | B2 * | 5/2005 | Loh | 257/81 |

* cited by examiner

*Primary Examiner*—Sandra O'Shea
*Assistant Examiner*—Jason Moon Han
(74) *Attorney, Agent, or Firm*—Lowe Hauptman & Berner LLP

(57) ABSTRACT

The present invention is designed to overcome the problems with MCPCB technology, which includes conductive solid body, typically copper or aluminum, typically having rods extending therefrom. This conductive solid body is fastened in place by a body constructed of typically plastic/Delrin® that the copper rods may be pressed or installed into. This body may be conductive or non-conductive. Each LED is mounted to a standard printed circuit board (PCB) or flexible circuit board that contains through holes large enough to fit the metal bottom of the LED through the hole far enough for the LED to make contact with the face of the solid body. Typically, board thickness of 0.032" or less is required for this to work effectively. The LED is glued to the face solid body via a thermally conductive, electrically neutral adhesive. The LED may also be adhered via thermal tape, thermal pad, or held against the solid body via its solder joints where no bonding of the LED is required.

25 Claims, 8 Drawing Sheets

VERSATILE THERMALLY ADVANCED LED FIXTURE

RELATED APPLICATION

The present invention claims priority from Provisional Application No. 60/481,387 filed on Sep. 17, 2003, entitled "VERSATILE THERMALLY ADVANCED LED FIXTURE".

FIELD OF THE INVENTION

The present invention relates generally to Light Emitting Diodes (LEDs), and more particularly, to a method of and apparatus for extracting heat from LEDs. Even more particularly, the present invention is directed to conducting heat away from high brightness LEDs.

BACKGROUND OF THE INVENTION

As LEDs have progressed over the past ten years and have become capable of handling more power than their early predecessor indicator LEDs, one area that becomes critical to the proper operation and longevity of the LED is thermal management. As stated in the document "Thermal Design Using Luxeon Power Light Sources" (Application Brief AB05) by Lumileds LLC, which is hereby incorporated by reference herein in its entirety (hereinafter "Thermal Design"), the manufacturer of the Luxeon High Brightness LED: "Proper thermal design is imperative to keep the LED emitter package below its rated temperature."

It is well known and a published fact that high brightness and high power LEDs need to be connected to an external heat sink for operation over extended periods of time. As stated by Lumileds in document "Luxeon Reliability" (Application Brief AB25), which is hereby incorporated by reference in its entirety:

> "While the reliability of Luxeon Power Light sources is very high, adherence to the device maximum ratings is required. The overall product reliability depends on the customer's drive conditions and adherence to recommended assembly practices. As with any other type of LED, extreme junction temperatures caused either by excessive power dissipation, an abnormally high thermal path, or improper assembly can cause thermal overstress failures."

As used herein, the term "HB LED" means LEDs of all types, light emitting polymers, and semiconductor dies that produce light in response to current that needs to be connected to a heat sink for optimal operation. Additional benefits of utilizing a heat sink include operation in higher ambient temperatures and the promotion of an extended life of the HB LED.

New methods designed to reduce thermal overstress failures of HB LEDs that are available include the utilization of aluminum substrates. Presently in the industry today, the use of Metal Core Printed Circuit Boards (MCPCB) or products based on this technology such as T-Clad™ by Bergquist Company offers a means of extracting the heat from High Brightness LEDs. Essentially, an MCPCB is a PCB (Printed Circuit Board) that utilizes an aluminum plate as a body as opposed to FR4, polyimide and other PCB and flexible circuit materials.

The process of installing an LED on an MCPCB is as follows. The LED must be glued to the MCPCB via a thermally conductive adhesive that is electrically neutral. The surface of the LED is glued typically to a copper pad on the dielectric layer of the MCPCB. Looking at the layers included in the MCPCB on the surface is the copper pad, below that is a dielectric layer, below the dielectric is the aluminum substrate. Once the LED is glued in place, the LED leads are soldered to the MCPCB. In some cases the LED is not glued in place, rather the LED's leads when soldered attach the LED to the board.

The use of MCPCBs in LED applications is very expensive. Besides the high price, MCPCBs are on a limited basis being offered by only several manufacturers. The uses of MCPCBs also do not promote the best cooling of the HB LED device. Since in most cases it is required to mount the aluminum substrate to an additional heat sink, a third junction is created (see page 4 of "Thermal Design"), which increases the thermal impedance of the assembly, thus in the long run, the life and performance of the HB LED.

It is also known that the base of most HB LEDs used for heat sinking is not electrically neutral. Therefore, consideration must be taken to electrically isolate this electrically conductive area. The MCPCB technology offers the solution of inserting a dielectric layer between the LED and the aluminum substrate. While this dielectric layer boasts decent thermal conductivity, it also plays a negative effect in the extraction of heat from the HB LED. Heat must transfer from the HB LED die, to the HB LED, to the thermally conductive adhesive holding the HB LED slug to the MCPCB assembly, through the copper pad that the HB LED is mounted to, through the dielectric layer, through the aluminum substrate, and finally to an external heat sink which will dissipate the heat into the ambient air. At each point, there is increased thermal resistance, thus the extraction of heat could be drastically improved.

Looking to the future as HB LEDs become more powerful and package size is not drastically increased, the extraction of heat from the HB LED will become more and more critical. As an example, present HB LEDs offer a thermal resistance of approximately 15 degrees Celsius per watt at the area where the die attach combines with die and material to contact with the die attach, as seen on page 4 of "Thermal Design". While a one watt LED sees internally a minor rise in temperature 15° C.) a 5 watt HB LED experiences a 75° C. rise internally inside the part (at the junction as described above), therefore leaving very little head room for the remainder of the thermal design as the LEDs have a maximum junction temperature typically in the area of 120–130° C. In order to heat sink a device such as a 5 watt HB LED, a minimum amount of thermal junctions will be required in order to assure proper extraction of heat from the HB LED.

SUMMARY OF THE INVENTION

It is, therefore, an aspect of the present invention to overcome the problems with MCPCB technology.

It is another aspect of the present invention to provide a fixture capable of providing sufficient heat transfer for high brightness LEDs.

These and other aspects of the present invention are achieved by a lighting system including a body with a plurality of through holes and a face, a plurality of rods with an end connected to the body, a circuit board with holes aligned in the body, and a plurality of LEDs each extending through the circuit board and the LEDs each fastened to the body.

The foregoing aspects of the present invention are also achieved by a lighting fixture including a body with a plurality of through holes and a face, a plurality of rods and a hollow center tube to connect the body and the electronic housing.

Still other aspects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and it several details are capable of modifications in various obvious respects, all without departing from the invention. Accordingly, the drawings are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BRIEF DESCRIPTION OF THE INVENTION

An apparatus for effectively transferring heat away from high brightness LEDs according to the present invention is described. In the following detailed description, for purposes of explanation, numerous specific details are set forth in order to provide a thorough understanding of the present invention. It will be readily apparent, however, that the present invention may be practiced without the specific details. In other instances, well-known structures and devices are shown in block diagram form in order to unnecessarily obscure the present invention.

Figure 1:
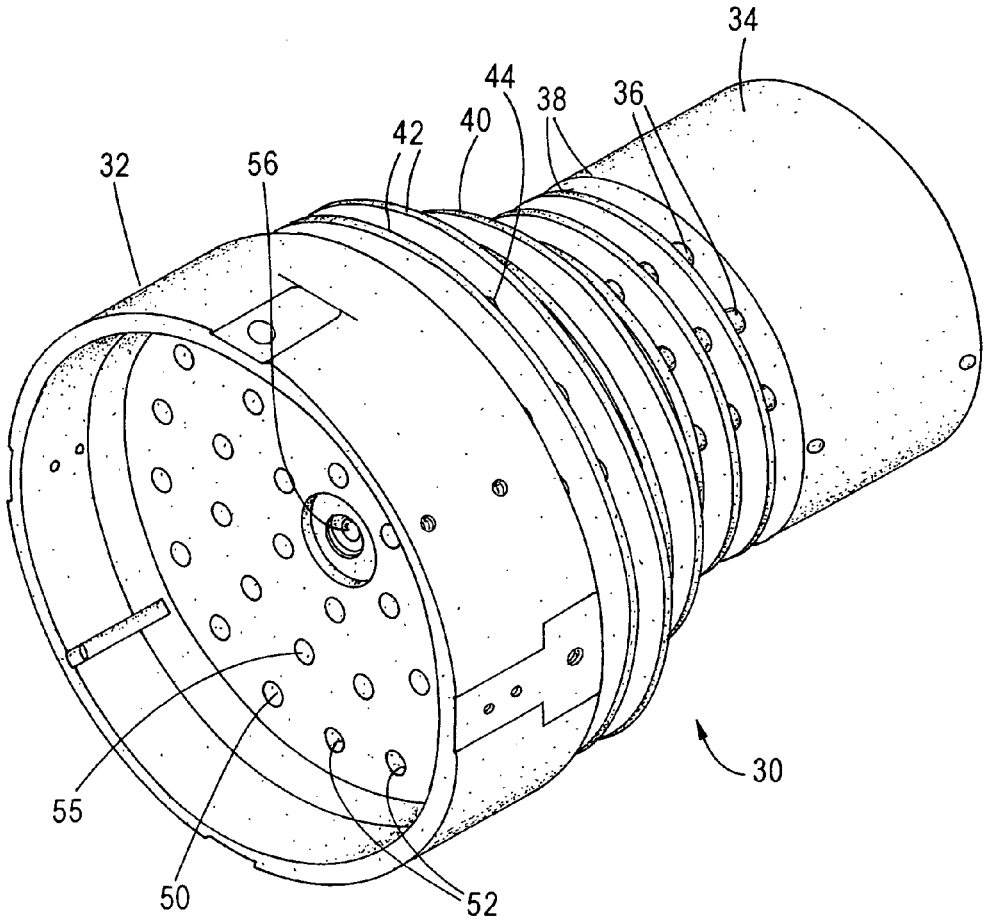
FIG. 1 is a perspective view of the thermally advanced LED Fixture with the LEDs omitted.

Referring first to FIG. 1, a thermally advanced LED fixture 30 is illustrated. The thermally advanced LED fixture 30 includes a conductive body 32 and an optional rear housing 34 which are connected by a plurality of cylindrically shaped rods 36. Although the body 32 and the rear housing 34 are illustrated as circular in configuration, any shape can be used. The rear housing 34 may contain electronics. A plurality of optional circular flat heat transfer fins 38, 40, 42 extend outwardly from the outer most rods and are press fit thereto. The heat transfer fins 38 are press fit to each of the circular rods 36 as are the heat transfer fins 40. The heat transfer fins 42 are press fit to shorter circular rods 44. The heat transfer fins 38 are spaced from each other and are mounted closest to the body 34, and are approximately the same diameter as the body 34. The heat transfer fins 40 are slightly larger in diameter than heat transfer fins 38 and are also spaced from each other. The heat transfer fins 42 are approximately the same diameter as the body 32 and are mounted closest to the body 32 and are also spaced from each other. The body 32 includes an innerwardly positioned flat face 50 having a plurality of through holes 52 which extend through the body 32. An optional hollow tube 56 extends through the center of the LED fixture 30 and into the body 32 and the body 34. The rods 36 and hollow tube 56 are flush with the face 50. Wires (not shown) can extend through the hollow tube 56 to power the LEDs 100.

The present invention is designed to overcome the problems with MCPCB technology, which includes conductive solid body 32, typically copper or aluminum, typically having rods extending therefrom. This conductive solid body 36 is fastened in place by a body 32 constructed of typically plastic/Delrin® that the copper rods 36 may be pressed or installed into. This body 32 may be conductive or non-conductive. Each LED 100 is mounted to a standard printed circuit board (PCB) or flexible circuit board (see FIGS. 4 and 7A) that contains through holes large enough to fit the conductive, typically aluminum bottom 102 of the LED through the hole far enough for the LED to make contact with the face 55 of the solid body 36 of the copper rod. The rods go all the way through the body 32 and are flush with the face 55. Typically, board thickness of 0.032" or less is required for this to work effectively. The LED is glued to the face 55 of the copper rod via a thermally conductive, electrically neutral adhesive 120 (see FIG. 4). The LED 100 may also be adhered via thermal tape, thermal pad, or held against the face 55 via its solder joints where no bonding of the LED is required (see FIGS. 5 and 6). If multiple solid bodies are used in an assembly, the use of a non-conductive body material offers an opportunity to electrically isolate the solid bodies, which will allow isolation of the LED 100. In the case of the HB LED, the heat is extracted out of the base. In the majority of situations, if the slug is to make electrical contact with the solid body, however, the solid body does not make electrical contact with any other solid body and is electrically isolated, there will be no negative effect on the LED 100 performance. This is beneficial when installing the LEDs on a curved surface using a flexible circuit (see FIGS. 7*a* and 7*b*) or when installing the LEDs by manual methods rather than automation. Both methods are not entirely consistent and there is always a possibility that an LED will make contact with the solid body. As the bottom of the LED is typically not electrically neutral, electrical problems may occur if the slugs of two or more LEDs make electrical contact with each other including the possibility of short circuit.

The solid body 36 of the copper rod is designed to extract the heat away from the LED 100 and into the surrounding air or another material. As materials such as copper and aluminum boast high thermal conductance, the heat is drawn from the LED 100, thus promoting a lower junction temperature. Generally, the power of the LED 100 and desired rise of the junction temperature are related to the length and diameter of the solid body 34. Generally, the longer the solid body 34 is the lower the junction temperature. In some cases, an assembly will include multiple LEDs which further complicate the thermal model of the system. In order to enhance the thermal characteristics of the solid bodies, one or many spaced thin copper, aluminum or other conductive material plates or fins 38, 40, 42 may be pressed over the rods 36 as illustrated in FIGS. 1, 2A, 2B and 4. This configuration increases the surface area of the assembly and allows the extracted heat by the solid body to be further spread prior to being dissipated into the air or surrounding body.

Figure 2A:
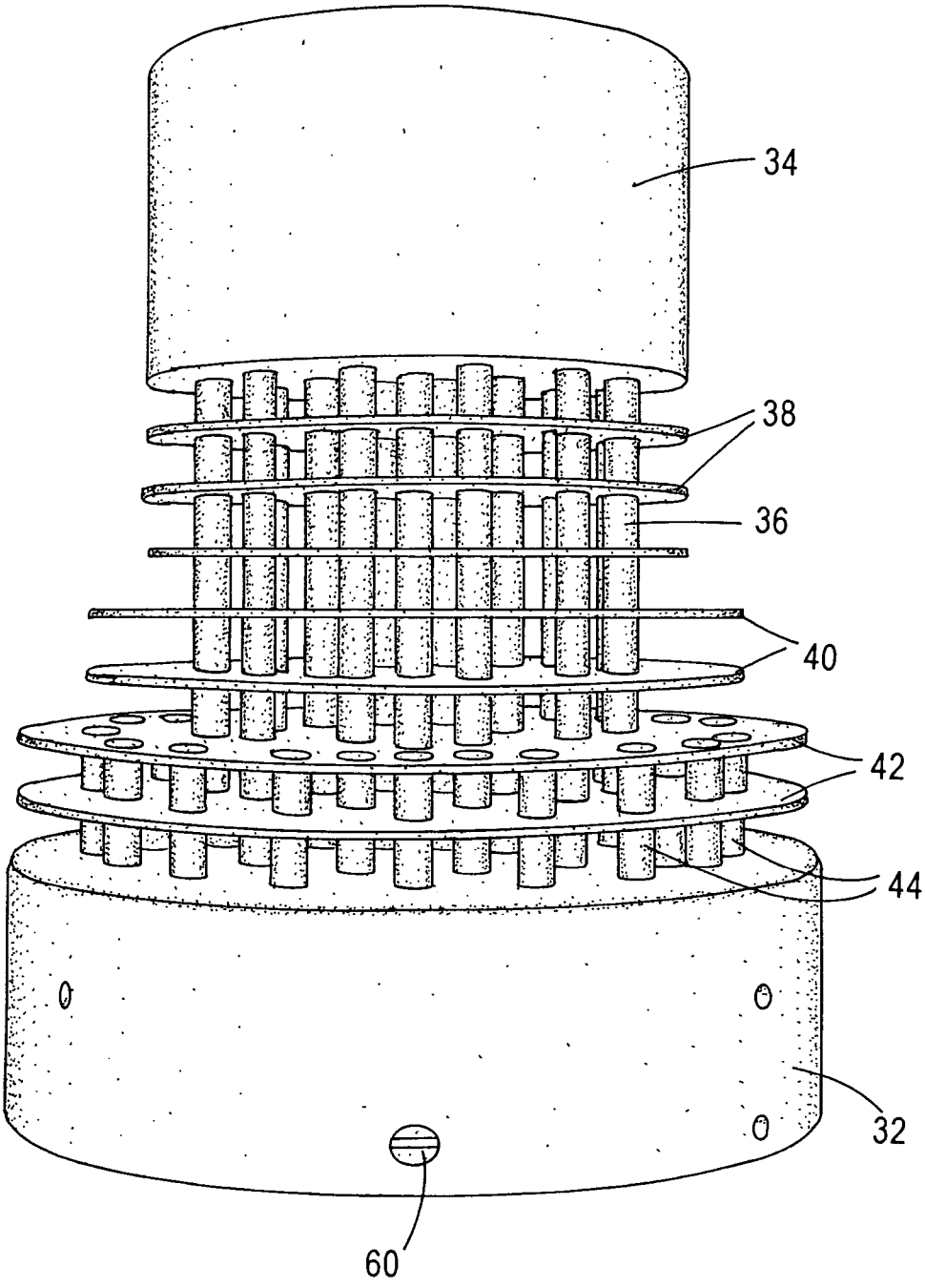
FIG. 2A is a side elevational view of the thermally advanced LED fixture of FIG. 1.
Figure 2B:
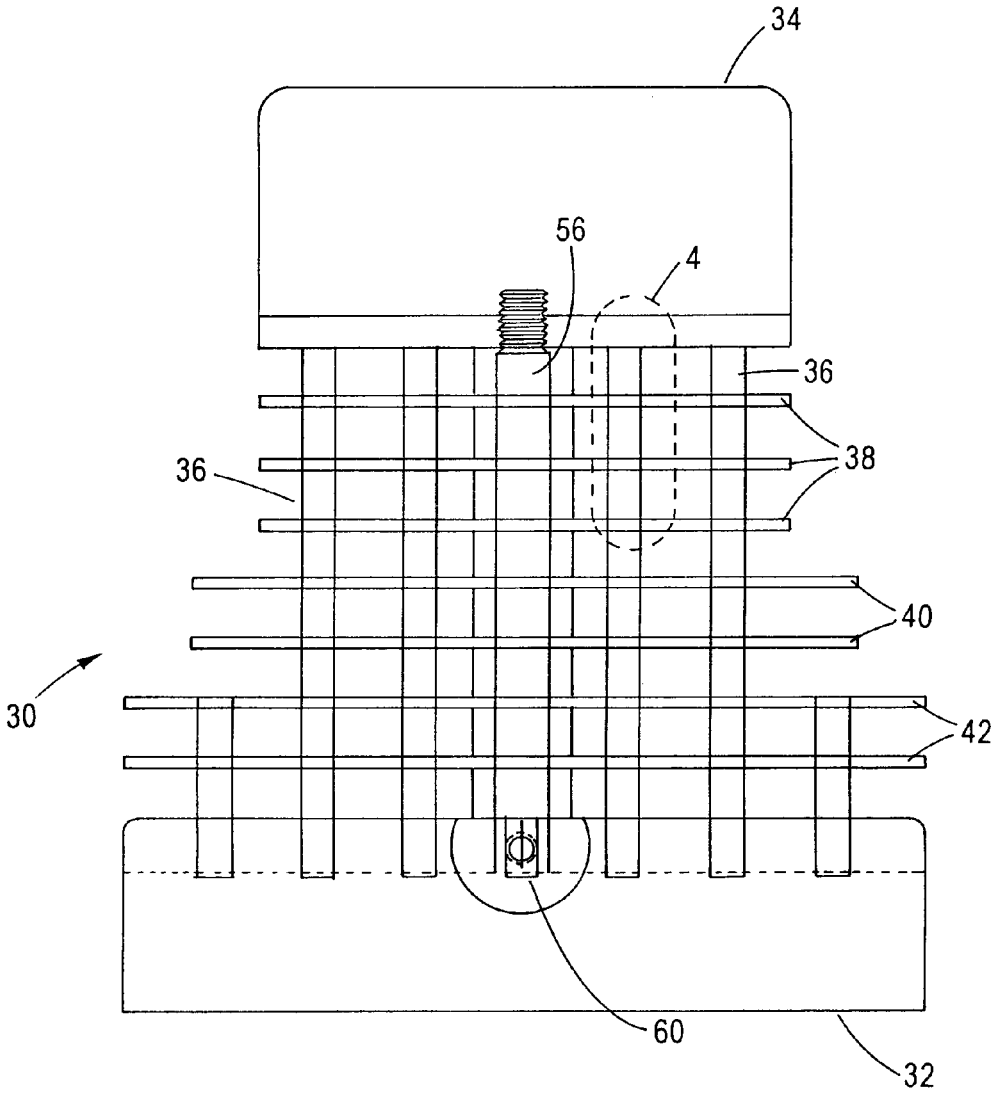
FIG. 2B is a cross sectional view of FIG. 2A.

Referring to FIGS. 2A and 2B, mounting or alignment holes 60 are used to fasten the fixture 10 to an enclosure, to a bracket, a stand or the fixture is mounted within a fixture. The mounting/alignment holes may be positioned in any configuration, quantity or size. The hollow tube 56 can be threaded into the body 32 and the housing 34.

Figure 3A:
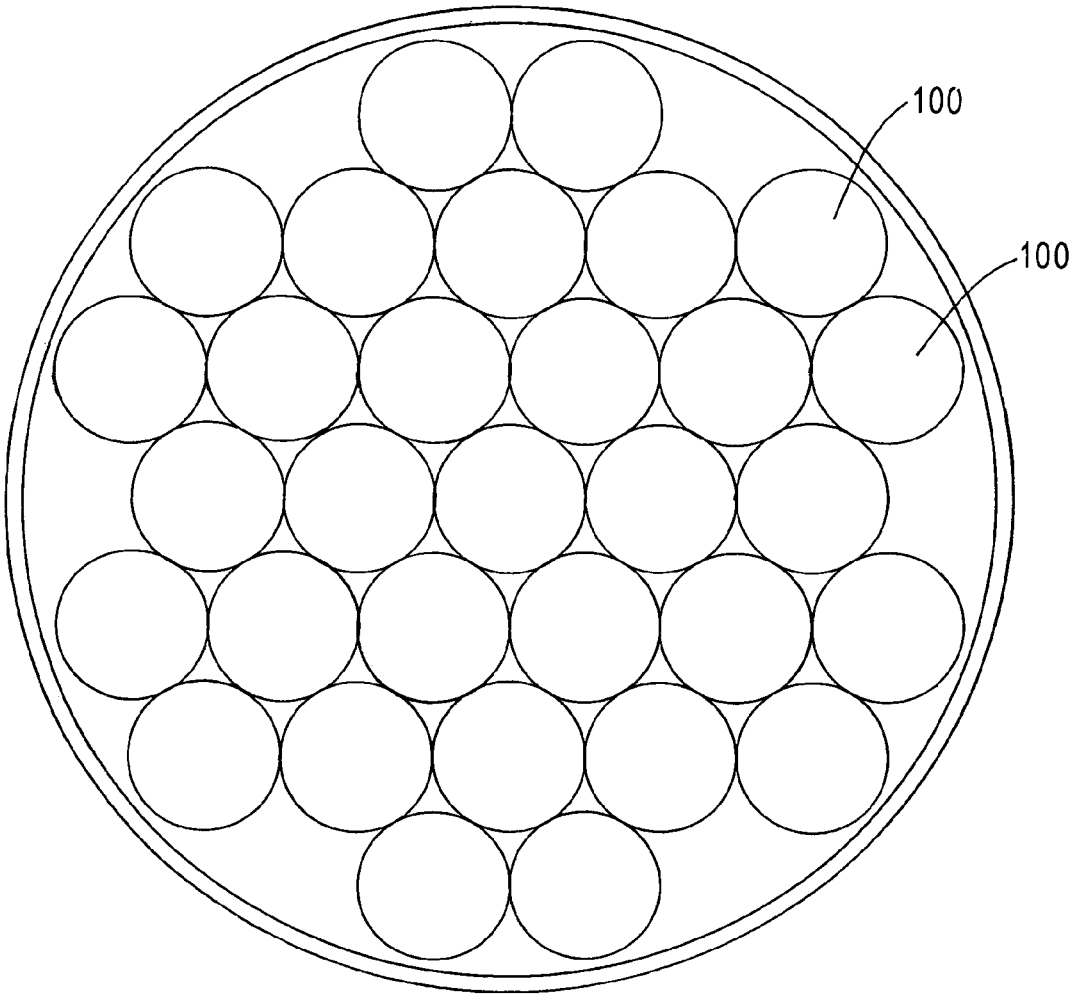
FIG. 3A is a front view illustrating the LED/lens configuration.
Figure 3B:
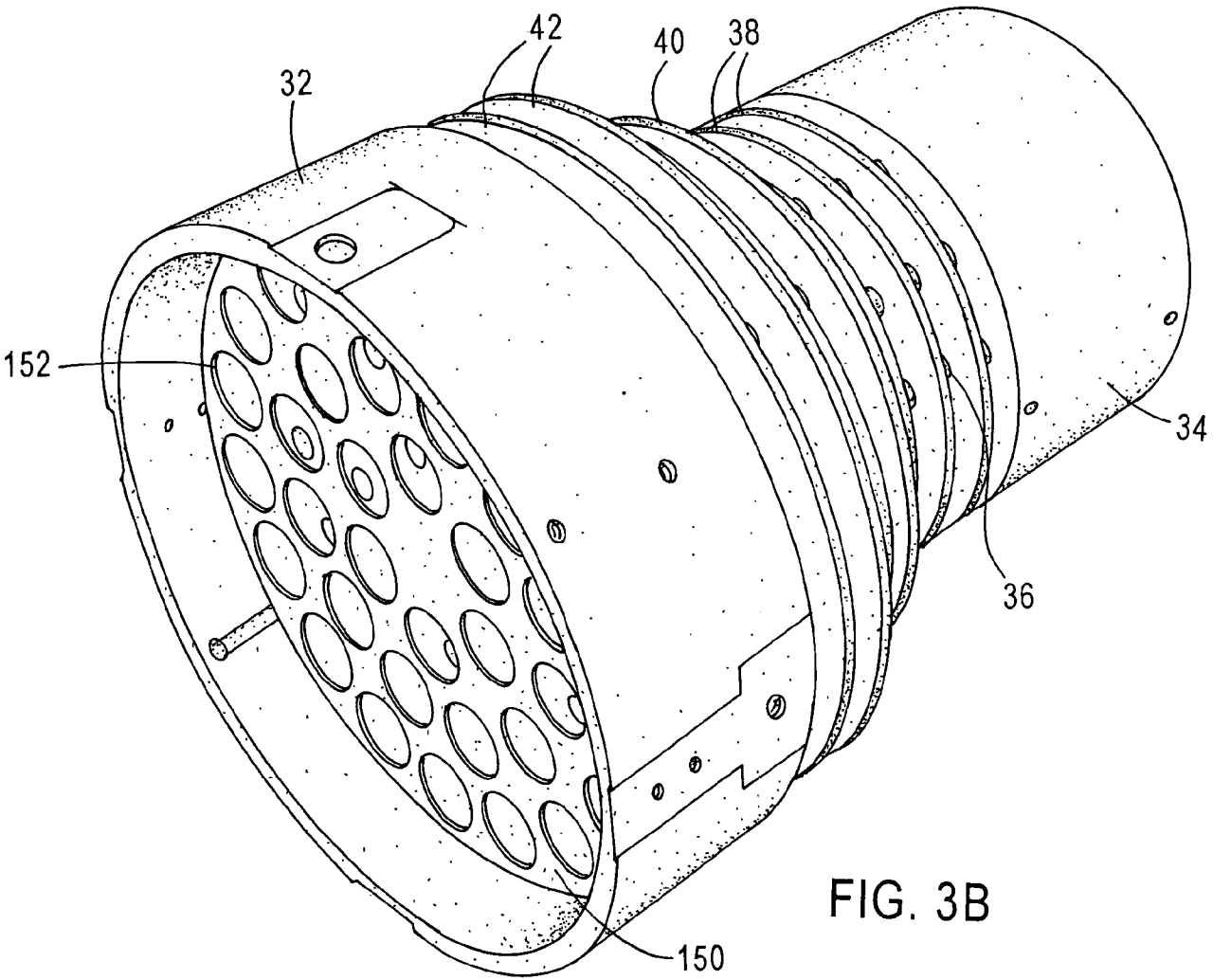
FIG. 3B is a perspective view of FIG. 3A showing a collimating lens holder placed over the LEDs.

Referring to FIG. 3A, the lens holder 150 configuration is illustrated in a front view. FIG. 3B is a perspective view of FIG. 3A.

Referring to FIG. 3B, a lens holder 150 is placed over multiple secondary collimating optics (not shown) (one optic per hole) that are sandwiched between the lens holder 150 through holes and the LEDs 100. The lens holder 150 is optional.

Figure 4:
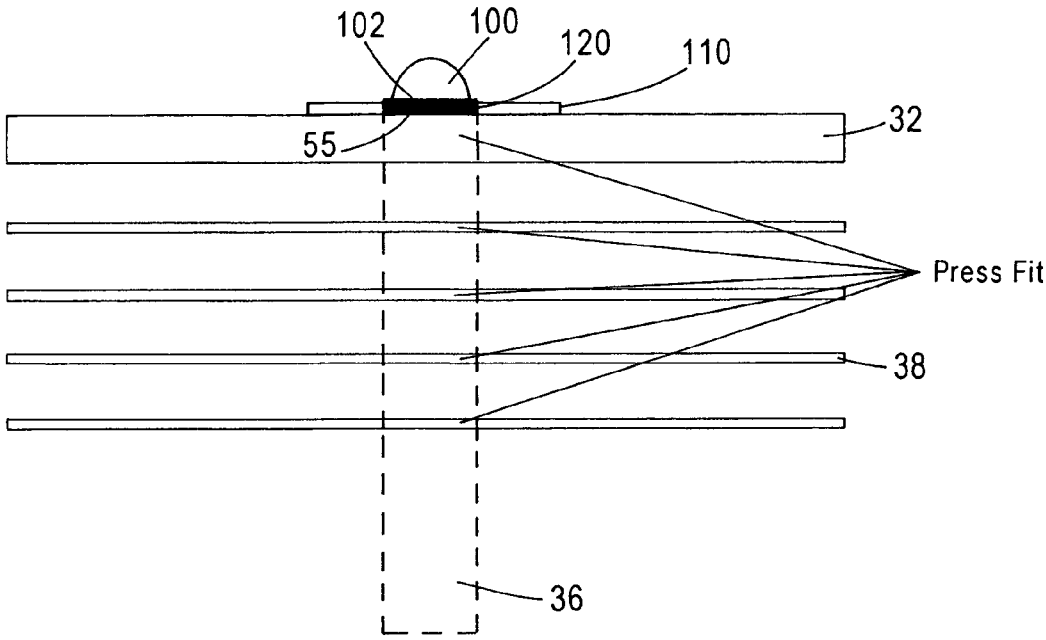
FIG. 4 is an enlarged view taken along dashed lines 4 in FIG. 2B.

Referring to FIG. 4, each LED 100 is attached to a printed circuit board 110 and is directly attached to the copper rod 36 by, for example, a thermally conductive epoxy. The LED 100 has a base 102 which is directly attached it to rod 36 which transfers the heat away from the LED 100. Thermal properties are based on the area of the materials as well as the diameter of the copper rod 36. Higher power LEDs 100 will require larger diameter rods 36.

Figure 5:
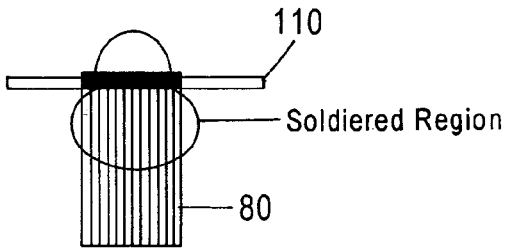
FIG. 5 is a cross sectional view showing an alternative embodiment of FIG. 4 using multiple copper wires.
Figure 6:
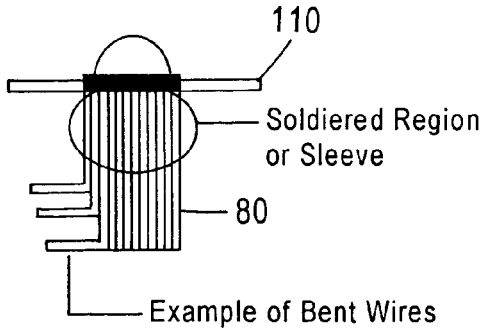
FIG. 6 is another alternative embodiment, similar to FIG. 5, showing bent wires.
Figure 7A:
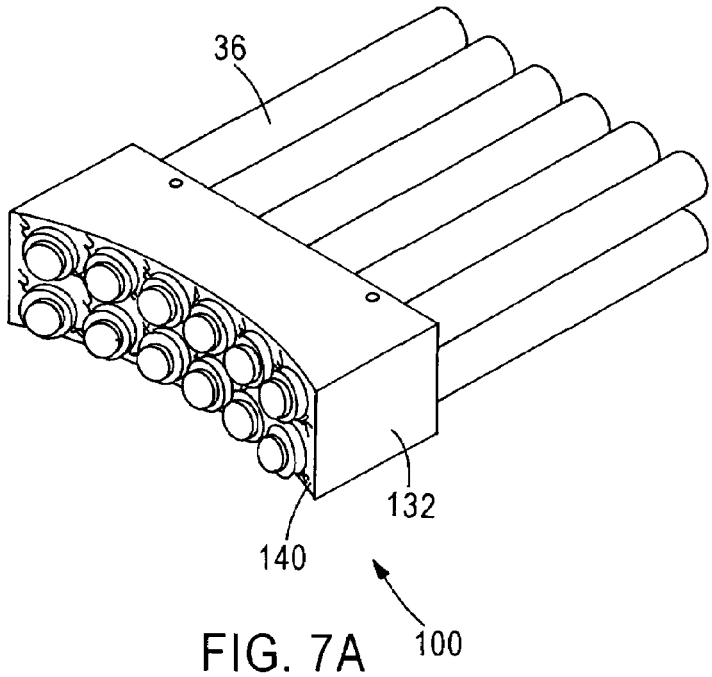
FIG. 7A is an alternative embodiment of the present invention illustrating a thermally advanced LED fixture for a flexible circuit board.
Figure 8:
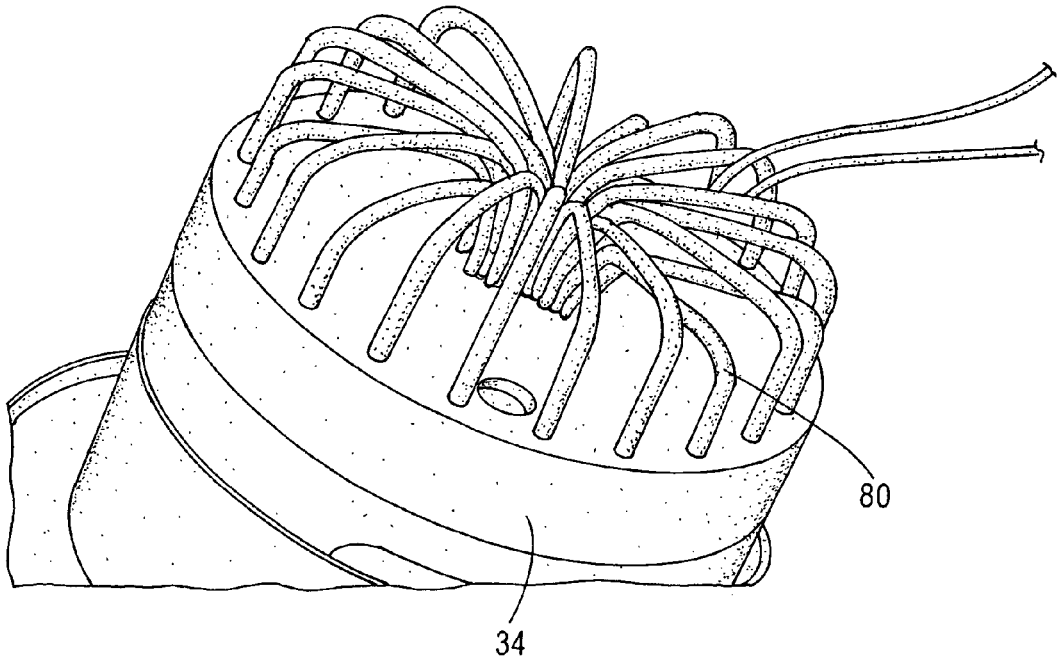
FIG. 8 is a bottom of the body using the alternative embodiment illustrated in FIG. 6.

An alternative embodiment is depicted in FIG. 5. Copper wire 80 may be used in place of the solid copper or aluminum rod 36. In this case, the copper will be soldered together at the point where the LED 100 base extends through the printed circuit board 110 as illustrated in FIG. 5. For enhanced heat dissipation, the copper can be spread out 360 degrees around the LED fixture 30 as illustrated in FIGS. 6 and 8.

Figure 7B:
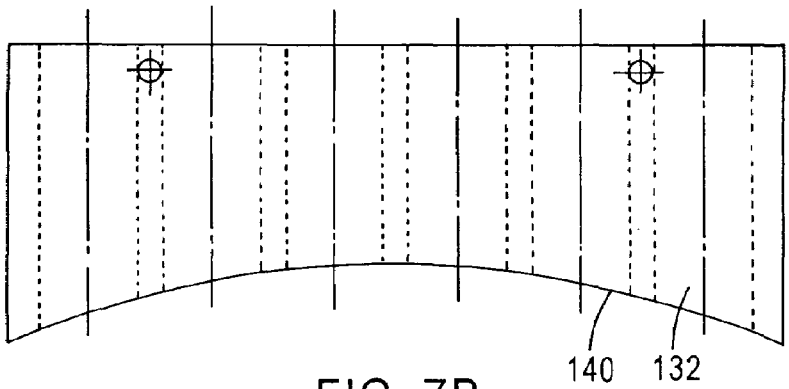
FIG. 7B is a cross sectional view of the body take along lines 7b—7b in FIG. 7A.
Figure 7C:
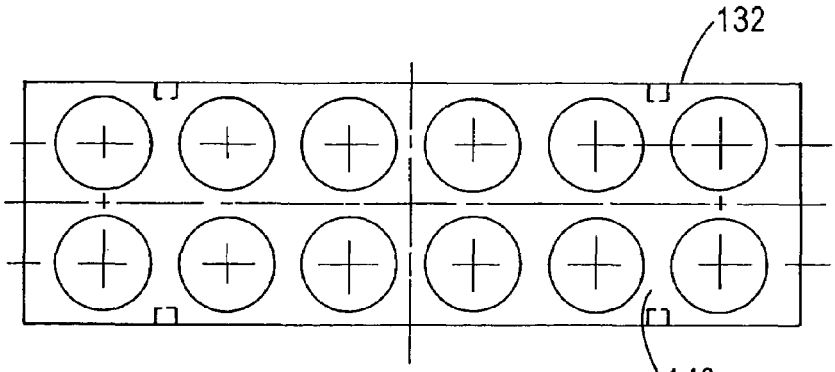
FIG. 7C is a front elevational view of the body of FIGS. 7A and B.

As mentioned above, and as depicted in FIG. 7A, the invention is compatible with flexible circuits, thus allowing the LEDs to be mounted around a radius, something an MCPCB cannot do. A rear housing is optional in the embodiments illustrated in FIGS. 7A–7C and also for the embodiments illustrated in FIGS. 1–6. The rear housing 34 is less important than the body 32. As depicted in FIG. 7B, the body 132 has a curved face 140. The solid bodies 36 may be electrically isolated from each other when using two or more LEDs in a system, thus there is no risk of the LEDs having problems due to an LED making contact with the solid body 36.

Advantageously, through the use of the invention described herein, when compared to the standard technology of the MCPCB, the number of thermal junctions is drastically decreased.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A lighting system, comprising:

a solid, essentially rectangular, housing having a plurality of through holes and a curved front face;

a plurality of thermally conductive rods each having an end disposed in a through hole in the housing, each rod having a length sufficient to extend into a space adjacent a rear face of the housing for heat exchange with a surrounding medium;

a circuit board with holes aligned with said holes in said housing and disposed on the curved front face; and a plurality of LEDs (Light Emitting Diodes), each extending through said circuit board, said LEDs each being fastened to a respective rod.

2. The lighting system of claim 1, further comprising a rear housing, said plurality of rods each having another end connected to said rear housing.

3. The lighting system of claim 2, further comprising a hollow center tube connecting said housing and said rear housing and wherein wires which are connected to said plurality of LEDs extend through said center tube.

4. The lighting system of claim 2, further comprising electronics housed in said rear housing.

5. The lighting system of claim 1, wherein said LEDs are fastened to said housing with one of a thermally conductive adhesive pad, a tape and an epoxy pad.

6. The lighting system of claim 5, wherein said thermally conductive adhesive pad, said tape and said epoxy pad are all electrically neutral.

7. The lighting system of claim 1, wherein said plurality of LEDs are high brightness LEDs.

8. The lighting system of claim 1, further comprising at least one fin which interconnects a majority of said rods and which is configured to improve the heat dispersion characteristics of the rods that are interconnected thereto.

9. The lighting system of claim 8, wherein said at least one fin comprises a plurality of fins which have different diameters.

10. The lighting system of claim 8, wherein the rods are solid.

11. The lighting system of claim 10, wherein said at least one fin comprises a plurality of fins which are spaced from one another, thermally conductive, exposed to air and are press fitted onto said rods.

12. The lighting system of claim 1, wherein said circuit board is one of a flexible circuit board and a rigid circuit board.

13. The lighting system of claim 1, wherein said housing has a layer of plastic on its rear face.

14. The lighting system of claim 13, wherein said housing is either electrically conductive or electrically non-conductive.

15. The light system of claim 1, wherein the housing is thermally non-conductive.

16. The light system of claim 1, wherein the housing is thermally conductive.

17. The lighting system of claim 16, wherein said housing is made of one of aluminum and copper.

18. A lighting fixture, comprising:

an essentially rectangular body having a plurality of through holes and a curved front face;

a plurality of rods configured for thermal conduction and each having an end received in a through hole; a plurality of LED (Light Emitting Diodes) which are respectively disposed on the ends of the rods that are received in the through holes of said body;

a circuit board with holes aligned with said through holes in said body and disposed on the curved front face; and a hollow center tube connecting said body and an electronic housing which is spaced from said body and connected thereto by said plurality of rods which extend between said body and said electronic housing and which are configured for heat exchange with a medium surrounding the same.

19. The lighting fixture of claim 18, wherein said body is thermally conductive.

20. The lighting fixture of claim 19, further comprising at least one fin thermally connectable to a majority of said plurality of rods.

21. The lighting fixture of claim 18, wherein said at least one fin comprises a plurality of fins which each have different diameters.

22. The lighting fixture of claim 18, wherein said body has a layer of plastic disposed on a rear surface thereof.

23. The lighting fixture of claim 22, wherein said body is either electrically conductive or electrically non-conductive.

24. The lighting fixture of claim 18, wherein said body is made of one of aluminum and copper.

25. The light system of claim 18, wherein the ends of the plurality of rods are configured to extend through the holes in the circuit board so as to be positioned on a radius due to the curvature of the curved front face.

* * * * *